United States Patent [19]

Jeromin et al.

[11] 4,398,818

[45] Aug. 16, 1983

[54] LIQUID TONER FOUNTAIN FOR THE DEVELOPMENT OF ELECTROSTATIC IMAGES

[75] Inventors: Lothar S. Jeromin, Sierra Madre; Wayne L. Kahler, Manhattan Beach, both of Calif.

[73] Assignee: Xerox Corporation, Stamford, Conn.

[21] Appl. No.: 193,855

[22] Filed: Oct. 3, 1980

[51] Int. Cl.[3] ..... G03G 15/10

[52] U.S. Cl. ..... 355/10; 134/122 P; 354/317; 354/324

[58] Field of Search ..... 355/3 R, 10; 354/317, 354/324; 118/659, 660; 134/64 P, 122 P

[56] References Cited

U.S. PATENT DOCUMENTS

| | | | |
|---|---|---|---|
| 3,407,786 | 10/1968 | Beyer et al. | 118/660 |
| 3,507,252 | 4/1970 | Leedom | 118/660 X |
| 3,712,203 | 1/1973 | Kishi et al. | 118/660 X |
| 3,831,556 | 8/1974 | Sato et al. | 355/10 X |
| 3,937,177 | 2/1976 | Lloyd | 118/50 |
| 4,110,029 | 8/1978 | Goshima et al. | 355/10 |
| 4,148,274 | 4/1979 | Stievenart et al. | 118/2 |
| 4,157,219 | 6/1979 | Ohta et al. | 355/10 |
| 4,198,923 | 4/1980 | Blumenthal | 118/660 |
| 4,270,859 | 6/1981 | Galbraith et al. | 355/10 |

FOREIGN PATENT DOCUMENTS

| | | | |
|---|---|---|---|
| 55-67770 | 5/1980 | Japan | 118/660 |

*Primary Examiner*—Fred L. Braun

[57] ABSTRACT

The components of the apparatus include multiple distribution plates with lateral liquid distribution to produce smooth streamline flow, a slotted metalized plastic electrode, and a funnel-shaped understructure which drains excess toner liquid into a sump to recover developer and prevent evaporation. The apparatus provides a laminar liquid flow in the gap between the charge bearing surface and the development electrode to prevent disturbance of the already deposited toner; the flow rate is even along the length of the fountain thereby avoiding density gradients due to uneven flow rates; the developer fluid in the gap is maintained free of debris by draining all fluid into the sump when the pump is turned off; the developer electrode is shaped to minimize highly localized and non-uniform field strengths and a centrifugal type pump is utilized to prevent toner agglomeration.

10 Claims, 5 Drawing Figures

LIQUID TONER FOUNTAIN FOR THE DEVELOPMENT OF ELECTROSTATIC IMAGES

BACKGROUND OF THE INVENTION

Xeroradiography, as disclosed in U.S. Pat. No. 2,666,144, is a process wherein an object is internally examined by subjecting the object to penetrating radiation. A uniform electrostatic charge is deposited on the surface of a xerographic plate and a latent electrostatic image is created by projecting the penetrating radiation, such as X-rays or gamma rays, through the object and onto the plate surface. The latent electrostatic image may be made visible by contacting the latent electrostatic image on the plate surface with fine powdered particles (toner) electrically charged opposite to the latent electrostatic image pattern on the plate in order to develop a positive image (in order to develop a negative image, the toner is of the same polarity as the latent electrostatic image pattern). The visible image may be viewed, photographed or transferred to another surface where it may be permanently affixed or otherwise utilized. The entire processing is dry, and no dark room is necessary.

Xeroradiography in recent years has been utilized to examine the extremities, the head, and to detect breast cancer in women. In examination of breasts wherein soft tissue comprises most of the breast area, xeroradiography, or xeromammography as it is generally called, provides greater resolving power than the conventional roentgenographic film and greater image detail is achieved. A wide range of contrast is seen on the xeroradiographic plate as compared to the conventional roentgenographic films so that all the structures of the breast from the skin to the chest wall and ribs may be readily visualized. Besides providing better contrast, xeromammography detects small structures like tumor calcification and magnifies them more than conventional film, is quicker, less expensive, gives greater detail and requires less radiation than prior nonphotoconductive X-ray techniques. The Xerox 125 system marketed by the Xerox Corporation, Stamford, Conn., is a commercially available apparatus for use in xeromammography.

Recent articles by Binnie et al (Application of Xeroradiography in Dentistry, *Journal Dent.*, 3:99-104, 1975) and Gratt et al (Xeroradiography of Dental Structures, I. Preliminary Investigations, *Oral Surg.*, 44:148-157, July 1977 and Xeroradiography of Dental Structures, II Image Analysis, *Oral Surg.*, 44:156-165, 1978) have described the application of the X-ray imaging in dentistry wherein the Xerox 125 system was utilized on phantoms and cadavers. The satisfactory intraoral results provided by this procedure prompted the development of an intraoral radiographic dental system based on xeroradiographic technology which would make the system acceptable to the dental profession.

The original development work on dental xeroradiography was accomplished with powder cloud development on the Xerox 125 System, the first developmental units suitable for intraoral dental xeroradiography employing a miniaturized version of the powder cloud development used in the Xerox 125 System. In addition to being electromechanically very complicated, powder development produced grainy images. Edge deletion control, an important feature in dental radiography where the objects to be x-rayed have high density contrast, could not be established satisfactorily. The lack of adequate deletion control, the presence of undesirable image grain and the complicated design prompted the investigation of other development techniques, and in particular, to liquid development.

Although many liquid toner development systems are commercially available, none of these met the image quality requirements and the high sensitivity characteristics of the toner utilized.

SUMMARY OF THE PRESENT INVENTION

The present invention provides apparatus for developing latent electrostatic images using a liquid toner fountain, images having low grain and high resolution being produced, the apparatus being particularly useful in xeroradiographic imaging systems.

The components of the apparatus include multiple distribution plates with lateral liquid distribution to produce smooth streamline flow, a slotted metalized plastic development electrode, and a funnel-shaped understructure which drains excess toner liquid into a sump to recover developer and prevent evaporation. The apparatus provides a laminar liquid flow in the gap between the charge bearing surface and the development electrode to prevent disturbance of the already deposited toner; the flow rate is even along the length of the fountain thereby avoiding density gradients due to uneven flow rates; the developer fluid in the gap is maintained free of debris by draining all fluid into the sump when the pump is turned off; the developer electrode is shaped to minimize highly localized and nonuniform field strengths and a centrifugal type pump is utilized to prevent toner agglomeration.

It is an object of the present invention to provide improved liquid toner development apparatus for developing latent electrostatic images.

It is a further object of the present invention to provide improved liquid toner development for developing latent electrostatic images formed during a xeroradiographic imaging process.

It is still a further object of the present invention to provide a liquid developer apparatus which includes multiple distribution plates with lateral liquid distribution to produce laminar flow, a slotted metalized electrode shaped to minimize highly localized and nonuniform field strengths and a funnel-shaped understructure which drains excess toner liquid into a sump to recover developer and prevent evaporation, images having low grain and high resolution being produced.

DESCRIPTION OF THE DRAWINGS

For a better understanding of the invention, as well as other objects and features thereof, reference is made to the following description which is to be read in conjunction with the accompanying drawings wherein.

DESCRIPTION OF THE PREFERRED EMBODIMENT

Although the liquid toner development system of the present invention can be utilized to develop electrostatic images formed by any imaging process, the discussion hereinafter will be directed to images formed by the xeroradiographic process to clearly illustrate the advantages of the present invention.

In order to preserve the image sense of film (negative imaging or development) when using the xeroradiographic process, a biased development electrode in a suspension of toner particles having the same polarity as the image charge was developed for use.

Figure 1A:
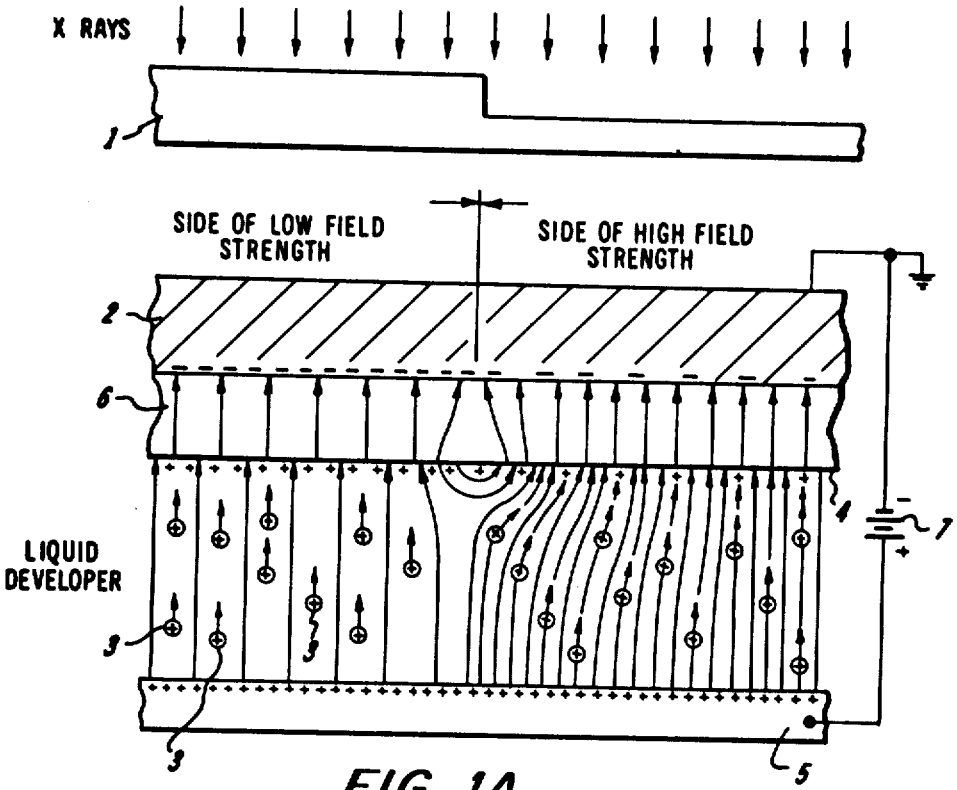
FIG. 1A is a side view of a charged photoreceptor in contact with developer liquid and shows the migration of toner particles at a step in charge level.
Figure 1B:
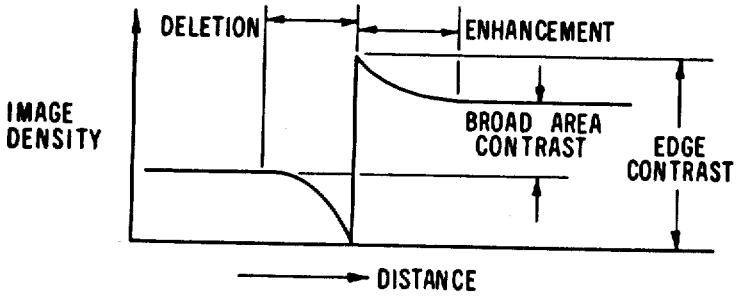
FIG. 1B is a graph of image density as a function of distance from the step.

In order to explain the advantages of liquid toner development in the xeroradiographic process, reference is made to FIG. 1.

For reasons of simplicity, the image of a step object 1 after an x-ray exposure is used. The left side of the step holds a higher charge density than the right side of the step; that is, the surface potential of the left side is higher than that of the right side. The development electrode is biased positively at a potential that is slightly higher than the left side of the step. The photoreceptor substrate 2 is at ground potential and the direction of the electric field is such that positively charged toner particles 3 in the developer region are forced toward the photoreceptor. Examining the field strengths, which are the forces that propel the toner particles, a higher field strength below the thinner side of the step results. This is due to the greater difference in potentials between the plate surface 4 and the development electrode 5. The higher field strength below the thin step is indicated by closer-spaced field lines. Assuming an infinite supply of uniformly distributed toner particles in the development region, the particles migrate along the field lines to the photoreceptor 6. The higher field strength will deposit more toner particles under the thinner step, resulting in a darker image on the side of the higher exposure.

When the field formation at the edge of the step is examined, both edge enhancement and deletion of the xeroradiographic image can be understood. These characteristics are primarily responsible for many advantageous qualities of xeroradiographic images over film images. Because of the surface potential difference between the steps, fringe field lines originate on the left and terminate on the right side of the step. The direction of the fringe field is such that the already higher field on the right side of the step edge is enhanced while the field strength on the left side is further diminished. Toner particles entering the field in the vicinity of the step edge encounter these fringe field forces which propel them toward the side of the thin step. It may be seen in FIG. 1 that the results is a peak toner deposition just on the right of the step edge (side of enhancement) and minimal deposition to the left (side of deletion). Far enough away from the enhanced and deleted regions, that is, outside the fringe field influence, toner deposition becomes uniform. The field strength, which governs the degree of enhancement, deletion, broad area contrast, and edge contrast, can be varied to obtain optimal image quality through change in both the development electrode bias 7 and the spacing between the development electrode and the plate. The standing wave of laminar flow produced by the development system of the present invention enables potential differences of a very few volts to be developed, thereby allowing very high resolution images to be produced. A set of development parameters consisting of electrode bias, electrode-to-plate gap, development time, and toner concentration which produced xeroradiographic images of desired diagnostic quality is set forth hereinafter.

Figure 2:
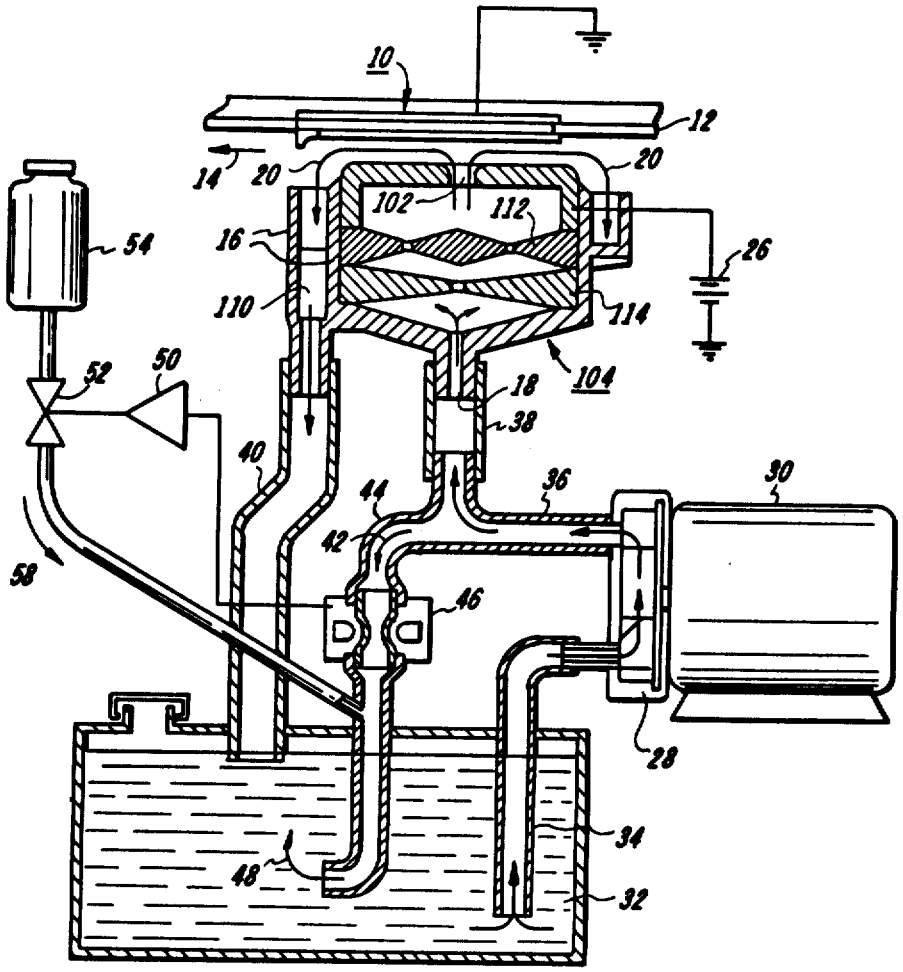
FIG. 2 illustrates the overall liquid toner development system of the present invention.

FIG. 2 illustrates, in schematic form, a liquid toner development system in accordance with the teachings of the present invention. The system has been successfully utilized in a xeroradiographic dental system manufactured by Xerox Corporation, Pasadena, Calif. and known as the Xerox 110 System. Details of the overall dental system are set forth, for example, in copending application Serial No. 060,074, filed July 24, 1979, now U.S. Pat. No. 4,346,983 and assigned to the assignee of the present invention, the teachings of which are necessary for an understanding of the present invention being incorporated herein by reference.

A photoconductive plate member 10 is pushed along plate track 12 by an input pusher mechanism (not shown) in the direction of arrow 14. In the illustration, the photoconductive plate surface, having the latent electrostatic charge pattern formed thereon, faces downwards towards the development system as it moves through the system. The conductive aluminum substrate of photoconductive member 10 is grounded during development.

A rectangular shaped housing or containment member 104 having an aperture 18 provides the liquid toner developer/flow (illustrated by arrows 20). The flow 20 is directed through rectangular shaped development electrode 100 having a slot 102 formed therein. A source of high voltage 26 is connected to development electrode 100 as shown.

The latent charge image on the surface of photoconductive member 10 is made visible preferably through electrophoretic development process using liquid development as herein described. Electrophoretic development may be defined as migration to and subsequent deposition of toner particles suspended in a liquid on an image receptor under the influence of electrostatic field forces. Electrophoretic developers are typically suspensions of very small toner particles in a dielectric field, typically an isoparaffinic hydrocarbon. Depending on the materials used and the formulation of the suspension, the toner particles may take on a positive or negative charge. In typical xeroradiographic development situations, since only fringe fields are extending into the developer, development will normally occur only at the edge of a change in object density. Therefore, the field is modified to achieve also broad area development to the surface of the photoconductive plate 10. Biased electrode 100 superimposes a uniform electric field on the fringe field and the combined development field geometry provides for the movement and deposition of the toner particles as set forth hereinabove.

The use of development electrode 100 biased positively in a suspension of toner particles having the same polarity as the charge image allows for negative image development which is the same development scheme used on x-ray film.

As set forth hereinabove, the development field and thus the degree of enhancement, deletion, broad area contrast and edge contrast can be varied to obtain optimal image quality through change of development electrode bias and spacing between development electrode and plate. Higher electrode bias reduces enhancement and deletion width at the expense of broad area contrast. Smaller electrode-to-plate gap increases broad area contrast, but diminishes edge enhancement and deletion. Factors affecting image density include development time and solids concentration in the developer. Spatial resolution in excess of 20 cycles/mm have been demonstrated with liquid developers. A set of development parameters consisting of electrode bias, electrode-to-plate gap, development time and toner concentration which has produced xeroradiographic images of excellent diagnostic quality are as follows:

Electrode bias: 1600 volts, positive
Electrode-to-plate gap: 0.050 inches
Development time: 2 seconds
Toner concentration: 0.30 Optical Density Units/mm A pump 28, driven by motor 30, removes developer from reservoir 32 and continually recirculates it through the housing 104 via ducts 34, 36, 38 and 40 as illustrated. The liquid flow over the development electrode is laminar, thus having the appearance of a standing wave. Image development is accomplished by traversing the plate 10 at a constant velocity through the standing wave. Development time, it should be noted, can be varied with plate velocity. Since the toner particles must be uniformly suspended in the liquid (forming the developer), constant stirring of the developer is required and is provided in the following manner. A portion 42 of the developer flow is diverted back to the reservoir 32 via duct 44 and past electro-optical sensor 46, the resultant flow 48 stirring the toner developer in the reservoir 32. To achieve consistent image density, the solids in the toner developer carried out by the developed plates have to be replenished. This is done automatically with a closed loop concentration control system. In particular, the optical density of the developer fluid 42 is continually measured electro-optically via sensor 46 and compared against a set, predetermined reference value. When the fluid density declines below the predetermined level, an electric impulse, amplified by amplifier 50, opens solenoid valve 52, valve 52 controlling a concentrate reservoir 54, thereby allowing concentrate to flow along path 58 into the developer in reservoir 32.

Figure 3A:
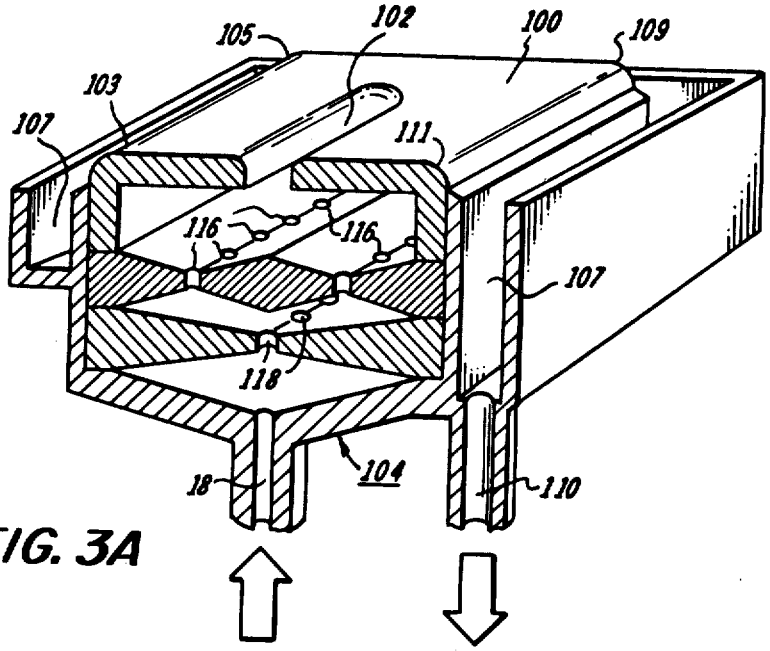
FIG. 3(*a*) is partial perspective, partial schematic view of the liquid fountain portion of the system shown in FIG. 2 and FIG. 3(*b*) is a full sectional view of the fountain shown in FIG. 3(*a*).
Figure 3B:
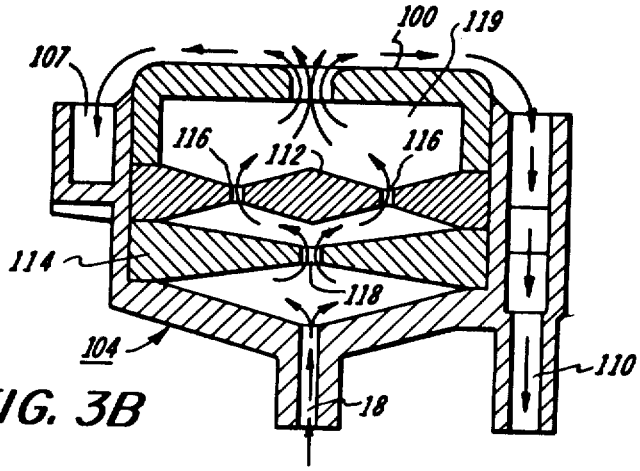

FIG. 3(*a*) is a sectional, perspective view of the liquid fountain of the present invention which may be utilized as a component in the development system shown in FIG. 2. A portion of the liquid fountain comprises the development electrode 100 (typically having an overall length of approximately 1.50 inches and width of approximately 1 inch) having an elongated slot 102 (typically having a length of approximately 1.250 inches and a width of approximately 0.125 inches) formed therein. The corners 103, 105, 109 and 111 and all other electrode surfaces and corners facing the photoreceptor have large radius, typically 0.125 inches, to minimize highly localized and non-uniform field strengths which could cause uneven development and possible electric breakdown. Electrode 100 in the preferred mode comprises either solid aluminum or metalized plastic, the metal layer of the electrode being connected to a high voltage source 26 (FIG. 2). A funnel shaped housing 104 is provided to position and support the electrode 100 therein. Housing 104 has an overflow basin 107 formed thereon with an outlet 110 on the lowest point for returning excess developer to the developer reservoir thereby minimizing developer evaporation. Basin 107 is preferably sloped in a manner such that the excess developer is efficiently directed to exit port 110 to promote drainage. A pair of plastic distribution plates 112 and 114 are also supported within housing 104, the distribution plates 112 and 114 and housing 104 forming the other portion of the liquid fountain. Distribution plate 112, shaped in the form of multiple, back-to-back wedges in the manner illustrated, has a plurality of holes 116 (typically nine) having a diameter in the range from about 50 to about 70 mils formed along two parallel rows along its lateral length. Distribution plate 114, supported within housing 104 below distribution plate 112 and shaped as back-to-back wedges, has a single row of holes 118 (typically nine) having a diameter in the range from about 70 to about 110 mils extending along its lateral length.

As shown also in FIG. 2, aperture 18 is provided in the housing 104 for allowing developer to enter the liquid fountain. The liquid fountain operates as follows: The liquid toner is first forced through the holes in distribution plates 112 and 114 to achieve uniform flow rate along the length of the fountain. The liquid toner then enters a large space 119 above the plates wherein the turbulent toner flow is minimized before leaving the electrode 100 through slot 102 in a laminar fashion and thus gives the appearance of a standing wave in the gap between development electrode 100 and the photoreceptor or other charge bearing surface. This feature allows the development of potential differences of a few volts thereby providing a high sensitivity development system. Slot opening 102, in the preferred mode, is selected to have an area greater than the total area of all the holes 116 in plate 112.

The spacing between the holes, which should be consistent, (and the hole diameter) was selected empirically. Although more than two distribution plates could be utilized, two were found to be sufficient to provide the laminar flow (one plate is not sufficient to distribute flow evenly along length of slot 102). The holes on each distribution plate are centered in the trough of each plate to prevent air bubbles which are generated at the start-up of pump 28 from being trapped underneath and allowing fluid toner from above to drain at shutdown through aperture 18. Holes 116 in plate 112 are located off-center from slot 102 and plate 112 is located above plate 114 to achieve the laminar flow.

Distribution plates 112 and 114 perform two important functions: air bubbles which normally would occur are substantially eliminated (air bubbles float to the highest points in the upside down troughs where they escape through the holes) and the well defined spacing between the holes (116 in plate 112 and 118 in plate 114), typically 140 mils, produces a uniform flow along the length of the electrode 100.

The liquid fountain component (due to holes 116 and 118 in the distribution plates) as set forth hereinabove provides a laminar liquid flow in the gap between the charge bearing surface and the development electrode 100, the laminar flow preventing disturbance of the toner already deposited on the charged photoreceptor surface and avoiding unwanted density gradients in the developed image. Drain basin 107 ensures that the developer fluid in the gap is maintained free of debris by draining all fluid into the reservoir when the pump is turned off. In particular, if a large quantity of fluid is left to evaporate each time the machine in which the liquid fountain is incorporated is turned off, the solids in the developer would be left behind to dry and form a hard film. If this evaporating and film-forming process occurs every time the machine is turned off, the film gets very thick. Eventually the solid layer will flake off.

enter the developer as hard chunks and deposit on the image causing artifacts. The present invention, in addition to the advantages set forth hereinabove, provides good drainage to avoid these artifacts.

While the invention has been described with reference to its preferred embodiments, it will be understood by those skilled in the art that various changes may be made and equivalents may be substituted for elements thereof without departing from the true spirit and scope of the present invention.

What is claimed is:

1. In an apparatus wherein a latent image is formed on an insulating member and wherein a device is incorporated for developing said image, the improvement comprising:

a member for bearing a latent image thereon, means disposed in an opposed relationship to said image bearing member for applying developer thereto, said applying means comprising a housing for receiving developer, a first plate member supported within said housing and having a plurality of holes formed thereon, a second plate member supported in said housing above said first plate member and having a plurality of holes formed thereon, and a development electrode positioned above said second plate member and having an elongated slot formed thereon, a voltage source connected to said development electrode, and means for supplying developer into the bottom of said housing, the developer being directed upward, passing through the holes formed in said first and second plates which equalizes the upward flow across the length and width of said housing, then passing through the space between said second plate and said electrode which is large enough in a vertical direction to allow the turbulence of the developer to be minimized, and thereafter out of said slot to produce a smooth laminar flow in the form of a standing wave over said electrode and toward said latent image whereby said latent image is developed.

2. The applying means as defined in claim 1 wherein the spatial arrangement of the holes in said first and second plates enables the liquid developer flow exiting from said elongated slot in said development electrode to be laminar.

3. The applying means as defined in claim 2 wherein said housing includes an overflow basin with an outlet at the lowest point for returning excess developer to a developer reservoir.

4. The applying means as defined in claim 3 wherein the electrode surfaces and corners facing the image bearing member each have a radius to minimize localized and non-uniform field strengths produced by said voltage source.

5. The applying means as defined in claim 4 wherein a centrifugal type pump is utilized to pump the liquid developer from the reservoir to said housing.

6. The applying means as defined in claim 5 wherein the area of said elongated slot is greater than the total area of all the holes in said second plate.

7. The applying means as defined in claim 1 wherein the latent image comprises an electrostatic charge pattern.

8. The apparatus of claim 1 wherein the bottom surfaces of said first and second plates are sloped upwardly toward said holes to allow bubbles within the housing to rise freely to the electrode slot.

9. In an apparatus wherein a latent image is formed on an insulating member and wherein a device is incorporated for developing said image, the improvement comprising:

a member for bearing a latent image thereon, means disposed in an opposed relationship to said image bearing member for applying developer liquid thereto, said applying means comprising a housing for receiving developer liquid, a first plate member supported within said housing and having a plurality of holes formed thereon, a second plate member supported in said housing above said first plate member and having a plurality of holes formed thereon, and a development electrode positioned above said second plate member and having an elongated slot formed thereon, a voltage source connected to said development electrode, and means coupled to said housing for supplying developer fluid thereto, the developer fluid being directed to pass through the holes formed in said first and second plates and said elongated slot and towards said latent image whereby said latent image is developed, wherein the spatial arrangement of the holes in said first and second plates enables the liquid developer flow exiting from said elongated slot in said development electrode to be laminar, said housing includes an overflow basin with an outlet at the lowest point for returning excess developer to a developer reservoir, the electrode surfaces and corners facing the image bearing member each have a radius to minimize localized and non-uniform field strengths produced by said voltage source, a space is provided between said second plate and the development electrode to receive the liquid developer exiting from the holes in said second plate, the area of said elongated slot is greater than the total area of all the holes in said second plate, and said second plate has a plurality of troughs associated therewith and said first plate has a single trough associated therewith, the holes in each plate being centered in their respective troughs.

10. The applying means as defined in claim 9 wherein the holes in said second plate are located off-center from the location of the elongated slot in said development electrode.

* * * * *